US008043555B2

(12) United States Patent
Smith et al.

(10) Patent No.: US 8,043,555 B2
(45) Date of Patent: Oct. 25, 2011

(54) CEMENTED TUNGSTEN CARBIDE ROCK BIT CONE

(75) Inventors: Redd H. Smith, The Woodlands, TX (US); Trevor Burgess, Aberdeen (GB); Jimmy W. Eason, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/632,371

(22) Filed: Dec. 7, 2009

(65) Prior Publication Data

US 2010/0116094 A1 May 13, 2010

Related U.S. Application Data

(62) Division of application No. 11/487,890, filed on Jul. 17, 2006, now abandoned.

(51) Int. Cl.
*C22C 1/05* (2006.01)
*C22C 29/00* (2006.01)

(52) U.S. Cl. ..... 419/44; 419/12; 419/13; 419/14; 419/17; 419/18; 419/28

(58) Field of Classification Search ..... 419/12–14, 419/17–18, 28; 175/425, 374
See application file for complete search history.

(56) References Cited

U.S. PATENT DOCUMENTS

| | | | | |
|---|---|---|---|---|
| 2,244,052 | A * | 6/1941 | Comstock | 76/104.1 |
| 4,630,692 | A | 12/1986 | Ecer | |
| 4,793,719 | A * | 12/1988 | Crockett et al. | 384/92 |
| 5,765,095 | A | 6/1998 | Flak et al. | |
| 5,963,775 | A | 10/1999 | Fang | |
| 2005/0247491 | A1 * | 11/2005 | Mirchandani et al. | 175/374 |
| 2007/0102199 | A1 * | 5/2007 | Smith et al. | 175/374 |

FOREIGN PATENT DOCUMENTS

WO WO2005/106183 A1 11/2005

OTHER PUBLICATIONS

U.S. Appl. No. 11/271,153, filed Nov. 10, 2005, Oxford, et al.
U.S. Appl. No. 11/272,439, filed Nov. 10, 2005, Smith, et al.

* cited by examiner

*Primary Examiner* — Roy King
*Assistant Examiner* — Ngoclan Mai
(74) *Attorney, Agent, or Firm* — Bracewell & Giuliani LLP

(57) ABSTRACT

An earth-boring bit has a steel body and bearing pin for rotatably supporting a cone. The cone has an exterior surface containing rows of cutting elements. The cone and cutting elements are formed of cemented tungsten carbide. The cone may be manufactured by applying pressure to a mixture of hard particles and metal alloy powder to form a billet, then machining the billet to a desired over-sized conical shaped product. Then the conical-shaped product is liquid-phase sintered to a desired density, which causes shrinking to the desired final shape.

12 Claims, 3 Drawing Sheets

CEMENTED TUNGSTEN CARBIDE ROCK BIT CONE

This application is a division of application Ser. No. 11/487,890, filed Jul. 17, 2006 now abandoned.

FIELD OF THE INVENTION

This invention relates in general to earth-boring bits having rotatable cones, and in particular to an earth boring bit having cones formed of a sintered particle composite material such as cemented tungsten carbide.

BACKGROUND OF THE INVENTION

Rotary drill bits are commonly used for drilling bore holes or wells in earth formations. One type of rotary drill bit is the roller cone bit (often referred to as a "rock" bit), which typically includes a plurality of conical cutting elements secured to legs dependent from the bit body. All bits have a body with a threaded upper end for connection to a drill string. The body has three depending legs each having a bearing pin. A rotatable cone is mounted on each of the bearing pins.

One type of bit has cones that have cemented carbide inserts or compacts press-fitted into mating holes formed in the exterior of the cone. The inserts protrude past the shell for engaging and disintegrating the earth formation. The inserts are formed by compacting a mixture of tungsten carbide particles and a metal binder within a die, then heating the pressed product to sinter it. The cone shells or bodies are formed of steel, thus the carbide inserts are much more resistant to abrasive wear than the shell of the cone. In drilling applications involving extended periods of operation, or a high content of abrasive particles in the formation and drilling fluid, extensive erosion and abrasion of the cone may occur, causing a loss of inserts.

Another type of cone has teeth that are milled or machined directly into the exterior surface of the steel cone. After machining the teeth, hardfacing is applied to the teeth, gage, and other surfaces of the cone to resist wear. The hardfacing typically comprises tungsten carbide granules or pellets embedded within a ferrous based matrix. A variety of different types of hardfacing particles are employed, including cemented tungsten carbide, cast tungsten carbide, macrocrystalline tungsten carbide and mixtures thereof. Typically, the hardfacing is applied manually using an oxy-acetylene torch. During application, a technician melts a steel tube containing the hardfacing particles with the flame and deposits the material on the selected portions of the cones.

Hardfacing applications are labor intensive, not well controlled or repeatable and also may inhibit the cutting structure because of the inherent bluntness of the resulting hardfaced teeth. Some grinding of the hardfacing to desired shapes may be performed. U.S. Pat. No. 6,766,870, assigned to the assignee of the present application and incorporated herein by this reference, discloses and illustrates a method of shaping hardfaced teeth through a secondary machining operation. However, sharpening the hardfaced teeth by grinding adds another relatively difficult and expensive step in the manufacturing process. Also, the portions of the cone shell that are not hardfaced may erode extensively in abrasive drilling conditions, causing a loss of teeth or the entire cone.

Another type of drill bit is a fixed-cutter bit, which does not have rotatable cones. Instead, a plurality of polycrystalline diamond cutting elements is secured to the cutting surface of the bit. In one type, the fixed-cutter bit has a bit crown formed of a particle-matrix composite material and joined to a steel shank. The shank has a threaded upper end for connection to the drill string. The particle-matrix bit crown is typically formed by placing hard particulate material, such as tungsten carbide, titanium carbide or tantalum carbide, in a cavity of a rigid mold defining the bit topography along with an alloy matrix material, such as a copper alloy. The mold, typically constructed of graphite with insertions of resin coated casting sand components, graphite or ceramic displacements, molding clay, or other geometry defining materials, is then placed in a furnace to melt the copper alloy and infiltrate and bond the tungsten carbide particles together. A steel blank may be embedded in the mold along with the tungsten carbide particles prior to applying heat. After the heat application and completion of the matrix infiltration, the blank is machined into a configuration to allow the attachment of a threaded shank. Alternatively, the bit crown could be formed separately and subsequently bonded to a threaded steel shank.

Since the particle-matrix bit crown cannot be readily machined because of its hardness after the casting process, the cavity of the mold must be formed with the net desired shape and size for the bit. The mold is intricate and requires extensive machining and hand finishing. The mold must usually be broken subsequent to the infiltration cycle to remove the finished bit crown and used only once, making particle-matrix bits costly.

Particle-matrix material used to form fixed cutter bit crowns differs from the cemented tungsten carbide used for the press-fit inserts or cutting elements of rotating cone bits in several ways. The material of a particle-matrix crown is normally of lower strength than the material of cemented tungsten carbide cutting elements. Cemented tungsten carbide material typically used for cutting elements normally has higher compressive, tensile and bending strengths than the material of a particle-matrix bit crown. The hard particles of the particle-matrix material are typically larger than the hard particles of liquid-phase sintered material, being typically at least 20-25 microns while the tungsten particles for a cemented tungsten carbide cutting element are typically less than 20 microns. The matrix of a particle-matrix bit crown typically comprises a copper-based alloy, while the binder of a cemented tungsten carbide cutting element is formed of cobalt, nickel, iron or alloys of them. The amount of binder in a particle-matrix bit crown is about 40 to 70% by volume, while the amount of binder in a cemented tungsten carbide cutting element is about 6 to 16% by weight.

The method of forming a particle-matrix bit crown differs greatly from the method of forming cemented tungsten carbide cutting elements. A principal difference is that a particle-matrix bit crown does not undergo the application of high pressure while in a mold. Rather the tungsten carbide powder is poured in the refractory mold, which has previously been configured to define the desired topography. It is during the furnace infiltration cycle that the copper alloy matrix melts and flows between the hard particles and bonds them together. Particle-matrix bit crown bits are processed in a furnace at lower temperatures and without a controlled atmosphere. The temperature used to form a particle-matrix bit crown is typically about 1180-1200 degrees C.

A cemented tungsten carbide cutting element, by contrast, is shaped by the use of high pressure to compact the hard metal particles and metal binder prior to sintering. Sintering of cemented tungsten carbide with other than lower melting temperature binders, such as copper based alloys, requires a vacuum or controlled atmosphere furnace. In the case of cemented carbides, the binder alloy is mixed and dispersed in the carbide aggregate prior to the initial pressing to shape of the component. During the furnace sintering cycle, the admixed binder particles melt and form a continuous phase that surrounds the hard aggregate particles. There is no flow of binder material from an external source or reservoir, as in the case of the infiltration of a matrix bit crown. The temperature for sintering a tungsten carbide cutting element is about 1320-1370 degrees C. High temperature processing in an oxygen containing atmosphere at these temperatures is not possible because of the oxidation that would occur to these materials at the processing temperature. The sintering step in cemented carbide results in significant shrinkage because the porosity in the pressed particulate component is eliminated as the binder material melts and the resulting surface tension of the molten binder pulls the particles together. In the case of the particle matrix bit crown, the interstitial volumes are filled with molten metal binder that is supplied from an external reservoir without significant compaction of the particle bed. Volumetric shrinkage values in the cemented carbide typically range from 20 to 50 percent, while no significant shrinkage occurs during the heating step of a particle-matrix bit crown.

SUMMARY OF THE INVENTION

In this invention, a cone for an earth-boring bit is formed entirely of a sintered hard particle composite material. In one embodiment, the cutting elements of the cone comprise teeth integrally formed with the cone. In another embodiment, the cutting elements comprise separately formed inserts press-fit into mating holes in the body of the cone. The hard particles of each of the cone and the cutting elements are from a material selected from diamond, boron carbide, boron nitride, aluminum nitride, and carbide or borides of the group consisting of W, Ti, Mo, Nb, V, Hf, Ta, Cr, Zr, A, and Si. The binder is selected from a group consisting of cobalt, nickel, iron, titanium and alloys thereof. The cone and the cutting elements may be free of or include hardfacing. The body of the bit and the bearing pin for the cones are preferably conventional and formed of a steel alloy.

In a preferred manufacturing technique, a powder mixture formed of hard particles and a metal binder is placed in a mold. Then high pressure is applied to the powder to form a billet. Preferably the billet has sufficient strength to retain a coherent shape, allowing the operator to machine the billet to create a cone-shaped product out of the billet. In the event pressing alone is insufficient to provide a strong enough billet to undergo machining, the operator optionally may pre-sinter the billet to a partially sintered condition before machining. In either method, the cone-shaped product will have at least some of its dimensions selectively oversized from the desired final dimensions. Then the cone-shaped product is placed in a furnace offering a vacuum, controlled atmosphere or elevated pressure conditions to sinter it to a desired density. Sintering causes shrinkage of the cone-shaped product to the desired final dimensions.

In one embodiment, the machining process before sintering includes machining teeth on the cone. In another embodiment, the machining process before sintering includes boring cutting element receptacles in the cone. Optionally, the operator may insert cylindrical displacement members into the holes, which remain during sintering to better define the shape and the limit the shrinkage of the holes. After sintering, the operator then press-fits separately formed carbide cutting elements into the holes.

The step of pressing the powder of hard particles and binder may be performed in two manners. In one method, the operator places the powder of hard particles and binder within a flexible impermeable container. The container is surrounded with a liquid, and pressure is applied to the liquid. In the other method, the operator places the powder within a cavity of a rigid mold. Then a ram is forced against the powder.

DETAILED DESCRIPTION OF THE INVENTION

Figure 1:
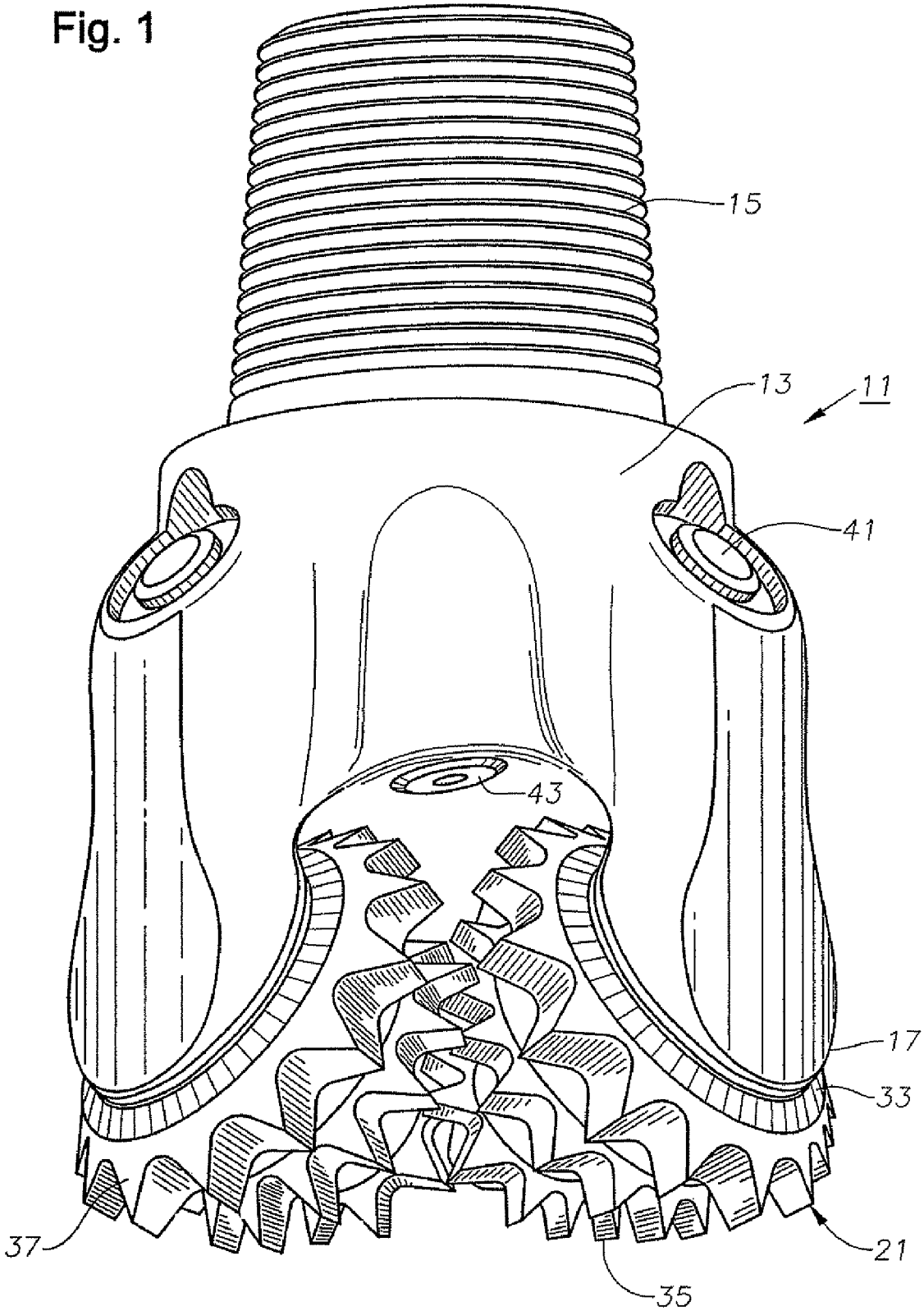
FIG. 1 is a side elevational view of an earth-boring bit constructed in accordance with one embodiment of this invention.
Figure 2:
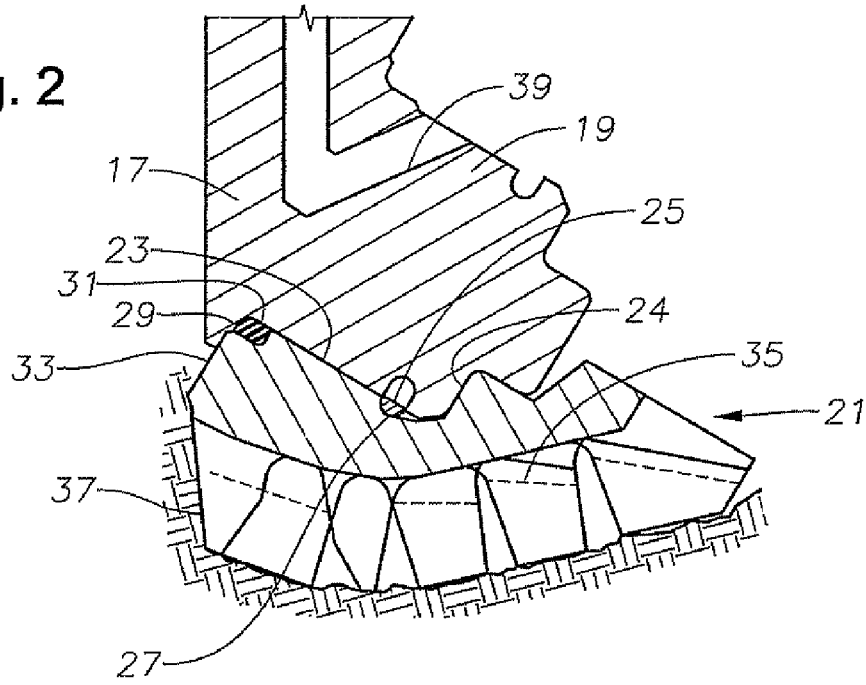
FIG. 2 is a partial sectional view of the bit of FIG. 1, illustrating one of the bearing pins, and the cutting structure of each of the multiple cones, all rotated into a single plane.

Referring to FIG. 1, earth-boring bit 11 has a body 13 with threads 15 formed on its upper end for connection into a drill string. Body 13 has three integrally formed bit legs 17. Each bit leg 17 has a bearing pin 19, as illustrated in FIG. 2. Preferably, bit body 13 and bearing pins 19 are formed conventionally of a steel alloy.

Each bit leg 17 supports a cone 21 on its bearing pin 19 (FIG. 2). Each cone 21 has a cavity 23 that is cylindrical for forming a journal bearing surface with bearing pin 19. Cavity 23 also has a flat thrust shoulder 24 for absorbing thrust imposed by the drill string on cone 21. Each cone 21 has a lock groove 25 formed in its cavity 23. In the example shown, a snap ring 27 is located in groove 25 and a mating groove formed on bearing pin 19 for locking cone 21 to bearing pin 19. Cone 21 has a seal groove 29 for receiving a seal 31. Seal groove 29 is located adjacent a back face 33 of cone 21. Seal 31 is shown to be an elastomeric ring, but it could be of other types. Back face 33 is a flat annular surface surrounding the entrance to cavity 23.

Cone 21 has a plurality of rows of cutting elements, which in the embodiment of FIGS. 1 and 2 comprise teeth 35. Teeth 35 are integrally machined from the material of the body or shell of each cone 21. Teeth 35 may vary in number, have a variety shapes, and the number of rows can vary. A conical gage surface 37 surrounds back face 33 and defines the outer diameter of bit 11.

Lubricant is supplied to the spaces between cavity 23 and bearing pin 19 by lubricant passages 39. Lubricant passages 39 lead to a reservoir that contains a pressure compensator 41 (FIG. 1) and may be of conventional design. Referring still to FIG. 1, bit body 13 has nozzles 43 for discharging drilling fluid into the borehole, which is returned along with cuttings up to the surface.

Figure 3:
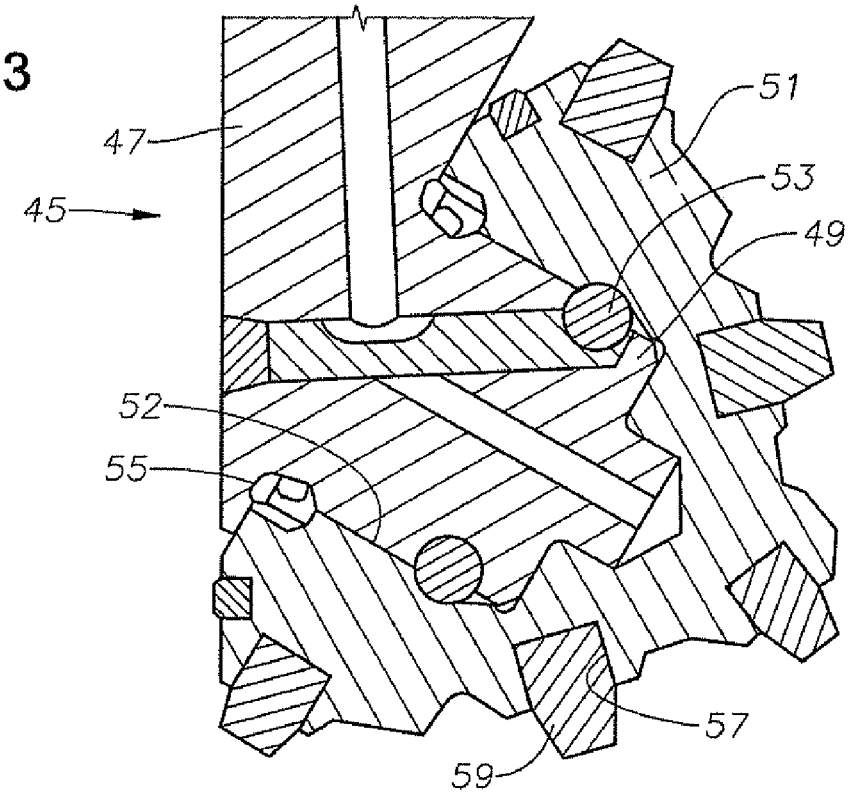
FIG. 3 is a partial sectional view of an alternate embodiment of a cone for the earth-boring bit of FIG. 1.

In the embodiment of FIG. 3, bit 45 also has a plurality of legs 47 (only one shown), and a bearing pin 49 depends from each bit leg 47. A cone 51 has a central cavity 52 that rotatably mounts to bearing pin 49, forming a journal bearing. In this example, cone 51 is retained on bearing pin 49 by a plurality of locking balls 53 located in mating grooves in cone cavity 52 and bearing pin 49. A seal assembly 55 seals the bearing spaces between cone cavity 52 and bearing pin 49. Seal assembly 55 may be different types and is shown as a metal face seal assembly. Cone 51 differs from cone 21 in that its cutting elements 59 comprise cemented tungsten carbide inserts press-fitted into mating holes 57 formed in the exterior of cone 51. Each insert 59 has a cylindrical barrel that fits within one of the holes 57 and a protruding cutting end that may be a variety of shapes.

Each cone 21 and 51 is preferably formed of a sintered hard particle composite material, which comprises hard particles and a metal binder. The hard particles may comprise diamond or ceramic materials such as carbides, nitrides, oxides, and borides (including boron carbide ($B_4C$)). More specifically, the hard particles may comprise carbides and borides made from elements such as W, Ti, Mo, Nb, V, Hf, Ta, Cr, Zr, Al, and Si. By way of example and not limitation, materials that may be used to form hard particles include tungsten carbide (WC, $W_2C$), titanium carbide (TiC), tantalum carbide (TaC), titanium diboride ($TiB_2$), chromium carbides, titanium nitride (TiN), vanadium carbide (VC), aluminum oxide ($Al_2O_3$), aluminum nitride (AlN), boron nitride (BN), and silicon carbide (SiC). Furthermore, combinations of different hard particles may be used to tailor the physical properties and characteristics of the particle-matrix composite material. The hard particles may be formed using techniques known to those of ordinary skill in the art. Most suitable materials for hard particles are commercially available and the formation of the remainder is within the ability of one of ordinary skill in the art.

The binder material may include, for example, cobalt-based, iron-based, nickel-based, iron and nickel-based, cobalt and nickel-based, iron and cobalt-based, aluminum-based, copper-based, magnesium-based, and titanium-based alloys. The binder material may also be selected from commercially pure elements such as cobalt, aluminum, copper, magnesium, titanium, iron, and nickel. By way of example and not limitation, the binder material may include carbon steel, alloy steel, stainless steel, tool steel, nickel or cobalt superalloy material, and low thermal expansion iron or nickel based alloys such as INVAR®. As used herein, the term "superalloy" refers to an iron, nickel, and cobalt based-alloys having at least 12% chromium by weight. Additional exemplary alloys that may be used as binder material include austenitic steels, nickel based superalloys such as INCONEL® 625M or Rene 95, and INVAR® type alloys having a coefficient of thermal expansion that more closely matches that of the hard particles used in the particular material. More closely matching the coefficient of thermal expansion of binder material with that of the hard particles offers advantages such as reducing problems associated with residual stresses and thermal fatigue. Another exemplary binder material is a Hadfield austenitic manganese steel (Fe with approximately 12% Mn by weight and 1.1% C by weight).

In one embodiment of the present invention, the sintered hard particle composite material may include a plurality of −400 ASTM (American Society for Testing and Materials) mesh tungsten carbide particles. For example, the tungsten carbide particles may be substantially composed of WC. As used herein, the phrase "−400 ASTM mesh particles" means particles that pass through an ASTM No. 400 mesh screen as defined in ASTM specification E11-04 entitled Standard Specification for Wire Cloth and Sieves for Testing Purposes. Such tungsten carbide particles may have a diameter of less than about 38 microns. The binder material may include a metal alloy comprising about 50% cobalt by weight and about 50% nickel by weight. The tungsten carbide particles may comprise between about 60% and about 95% by weight of the composite material, and the binder material may comprise between about 5% and about 40% by weight of the composite material. More particularly, the tungsten carbide particles may comprise between about 70% and about 80% by weight of the composite material, and the binder material may comprise between about 20% and about 30% by weight of the composite material.

In another embodiment of the present invention, the sintered hard particle composite material may include a plurality of −635 ASTM mesh tungsten carbide particles. As used herein, the phrase "−635 ASTM mesh particles" means particles that pass through an ASTM No. 635 mesh screen as defined in ASTM specification E11-04 entitled Standard Specification for Wire Cloth and Sieves for Testing Purposes. Such tungsten carbide particles may have a diameter of less than about 20 microns. The binder material may include a cobalt-based metal alloy comprising substantially commercially pure cobalt. For example, the binder material may include greater than about 98% cobalt by weight. The tungsten carbide particles may comprise between about 60% and about 95% by weight of the composite material, and the binder material may comprise between about 5% and about 40% by weight of the composite material. After forming, cone 21 or 51 will have a hardness in a range from about 75 to 92 Rockwell A.

Figure 4:
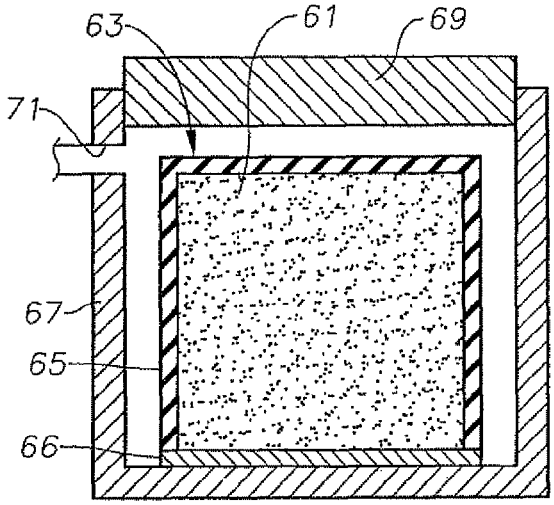
FIG. 4 is a schematic view illustrating a step of isostatically pressing hard particles and a metal binder powder to form a billet for the cone of FIG. 2 or 3.

FIG. 4 illustrates one step of a method of forming cone 21 (FIG. 2.) or cone 51 (FIG. 3) of substantially a sintered hard particle composite material. The method generally includes providing a powder mixture, pressing the powder mixture to form a billet, machining the billet into a desired cone-shaped product, and then sintering the cone-shaped product into the desired cone 21 or 51. Optionally, if necessary to add strength to the billet, the billet could be partially sintered prior to machining.

Referring to FIG. 4, a powder mixture 61 may be pressed with substantially isostatic pressure within a mold or container 63. The powder mixture 61 includes a plurality of the previously described hard particles and a plurality of particles comprising a binder material, as also previously described herein. Optionally, powder mixture 61 may further include additives commonly used when pressing powder mixtures such as, for example, materials for providing lubrication during pressing and for providing structural strength to the pressed powder component, plasticizers for making the binder more pliable, and lubricants or compaction aids for reducing inter-particle friction.

Container 63 may include a fluid-tight deformable member 65. For example, deformable member 65 may be a substantially cylindrical bag comprising a deformable and impermeable polymeric material, preferably an elastomer such as rubber, neoprene, silicone, or polyurethane. Container 63 may further include a sealing plate 66, which may be substantially rigid. Deformable member 65 is filled with powder mixture 61 and optionally vibrated to provide a uniform distribution of the powder mixture 61 within the deformable member 65. Sealing plate 66 is attached or bonded to deformable member 65, providing a fluid-tight seal therebetween.

Container 63, with the powder mixture 61 therein, is placed within a pressure chamber 67. A removable cover 69 may be used to provide access to the interior of the pressure chamber 67. A fluid is pumped into pressure chamber 67 through a port 71 at high pressures using a pump (not shown). The fluid is preferably a generally incompressible liquid, such as water or oil; however, it could be or contain a gas, such as, air or nitrogen. The high pressure of the fluid causes member 65 to deform. The fluid pressure is transmitted substantially uniformly to the powder mixture 61. The pressure within pressure chamber 67 during isostatic pressing may be greater than about 35 megapascals (about 5,000 pounds per square inch). More particularly, the pressure within pressure chamber 67 during isostatic pressing may be greater than about 138 megapascals (20,000 pounds per square inch).

In alternative methods, a vacuum may be provided within flexible container 63 and a pressure greater than about 0.1 megapascals (about 15 pounds per square inch) may be applied to deformable member 65 of container 63 (by, for example, the atmosphere) to compact powder mixture 61. Isostatic pressing of the powder mixture 61 forms a billet, which is removed from pressure chamber 67 and container 63 after pressing for machining. The billet will have a generally cylindrical configuration if formed by the equipment of FIG. 4.

Figure 5:
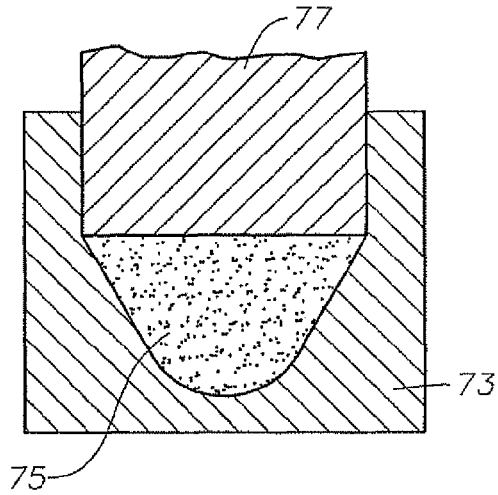
FIG. 5 is a schematic view illustrating an alternate embodiment step to that of FIG. 3, wherein the billet is formed under pressure imposed by a ram and die.

Referring to FIG. 5, an alternative method of forming an unsintered billet comprises using a rigid die 73 having a cavity for receiving a powder mixture 75. Powder mixture 75 may be the same as powder mixture 61 of the embodiment of FIG. 4. The cavity of die 73 may be generally conically-shaped, if desired to form an overall conical billet. Alternately, the cavity could be cylindrical, resulting in the formation of a cylindrical billet. A piston or ram 77 sealingly engages the walls of die 73 above powder 75. Downward force on piston 77 presses powder mixture 75 into a coherent shape suitable for machining.

In the preferred method, the billet, whether formed as in FIG. 4 or FIG. 5, is machined without pre-sintering into the desired configuration. However, some pre-sintering could take place if desired, particularly with larger sizes of cones 21 or 51. The machining is performed substantially in the same manner as the operator would machine a cone formed of steel in the prior art. However, because of the shrinkage later to occur during sintering, the dimensions of the cone-shaped unsintered product are over-sized. Because of the years of experience in forming tungsten carbide cutting elements such as inserts 59 in FIG. 3, it is known in the art in general how much a hard particle composite product will shrink during sintering. More accurate values of shrinkage may be experimentally determined for particle mixtures prior to determining the appropriate expanded component geometries. The various dimensions provided to the machinist will be oversized to account for this shrinkage.

In regard to cone 21 (FIG. 2) during machining of the unsintered billet, the operator will form virtually all structural features of cone 21, including teeth 35, cavity 23, seal groove 29, lock groove 25 and thrust face 24. Similarly, in regard to cone 51 (FIG. 4), the operator will form the body of cone 51, cavity 52 and holes 57 for inserts 59. Inserts 59 will be formed separately in a conventional manner. Although also formed of a sintered particle composite material, inserts 59 will normally be of a different type and composition than the body of cone 51.

Figure 6:
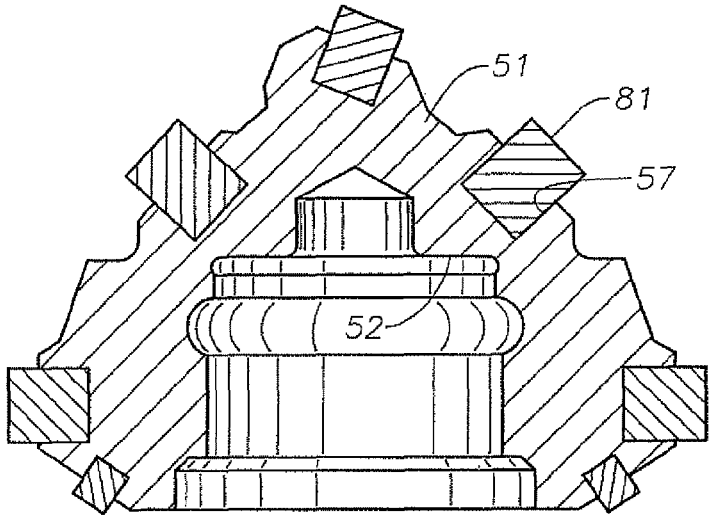
FIG. 6 is a schematic view illustrating the cone of FIG. 3 after undergoing sintering within a vacuum furnace and before installation of cutting element inserts.

The operator then places the machined cone-shaped product in a furnace and applies heat until it is fully dense. Preferably, the furnace is one offering a vacuum, controlled atmosphere or elevated pressure conditions. The sintering is performed conventionally either under a vacuum or in a controlled atmosphere other than air. When sintering insert-type cones 51, as illustrated, optional displacement members 81 are inserted into holes 57, as shown in FIG. 6. Displacement members 81 comprise dowels that are dimensioned to the desired final dimensions of hole 57 for each insert 59 (FIG. 3). Displacement members 81 are formed of a material, such as a ceramic, that is stable under the sintering temperatures. Holes 57 are larger in diameter than displacement members 81 before sintering, and shrink during sintering to the diameters of members 81. FIG. 6 shows the appearance after sintering. The sintering temperature is conventional for the particular particle composite material. One such temperature for sintered tungsten carbide material having a cobalt binder is in a range from about 1320 to 1500 degrees C.

During the sintering process, the density will increase and the cone-shaped product will undergo shrinkage. After sintering, cone 21 will have the desired exterior configuration for teeth 35, back face 33 and gage surface 37. Limited or no further machining should be necessary for these surfaces. Finish machining of cavity 23 may be needed, particularly grinding and polishing to achieve the desired surface finish. In regard to insert cone 51, it too may require finish machining of its cavity 52. However, very little metal is removed during the finish machining processes, therefore, even though cones 21 and 51 are quite hard at this point, finish machining can be performed relatively easily.

After cone 21 (FIG. 2) is sintered and finish machined, it is mounted to bearing pin 19 (FIG. 2) in a conventional manner. The bearing surfaces are lubricated with lubricant in the same manner as occurs with cones formed of steel. Cone 21 may or may not have any hardfacing on its exterior. Some hardfacing may be employed on bit body 13, particularly on bit leg 17. Similarly, after cone 51 (FIG. 3) is sintered, displacement members 81 are removed and inserts 59 will be pressed into holes 57. Inserts 59 may also be bonded into holes 57 using adhesives, soldering, brazing techniques known in the art. Cone cavity 52 will be finish machined and cone 51 will be mounted to bearing pin 49 in a conventional manner.

In another method of manufacturing, rather than forming a billet of unsintered or partially sintered tungsten carbide, the operator will liquid-phase sinter a billet to a final density and hardness. Machining is performed with traditional or ultrasonic machining methods. Ultrasonic methods apply a high frequency vibratory motion to the rotary tooling to enhance material removal.

The invention has significant advantages. The cone is very resistant to erosion and wear as it is formed of a material much harder than the prior art steel. Labor intensive hardfacing applications are reduced or eliminated.

While the invention has been shown in only a few of its forms, it should be apparent to those skilled in the art that it is not so limited but susceptible to various changes without departing from the scope of the invention.

The invention claimed is:

1. A method of manufacturing a cone for an earth boring bit, comprising:

(a) placing a powder of hard particles and a metal binder in a mold; then (b) applying pressure to the powder to form a billet;

(c) machining the billet to create a cone-shaped product out of the billet that has at least some dimensions selectively oversized from desired final dimensions of the cone; then (d) sintering the cone-shaped product to a desired density, the sintering causing the cone-shaped product to shrink to substantially to the desired final dimensions of the cone; wherein the method further comprises:

inserting cylindrical displacement members into the holes after step (c) and before step (d), the displacement members having the desired finished diameters for the holes and being of a material that does not shrink during the sintering in step (d);

and step (d) further comprises leaving the displacement members in the holes while sintering, which causes the holes formed in the billet to shrink in diameter around the displacement members to the desired finished diameter; and after step (d), removing the displacement members, then installing the cutting elements in the holes.

2. The method according to claim 1, wherein step (c) is performed while the billet is in a completely unsintered condition.

3. The method according to claim 1, further comprising:

after step (b) and prior to step (c), heating the billet to partially sinter the billet.

4. The method according to claim 1, wherein:

step (c) further comprises machining a cylindrical cavity within the billet for mounting the cone to a bearing shaft of the bit; and the method further comprises after step (d), finish machining the cylindrical cavity into a bearing surface having a desired dimension and surface finish.

5. The method according to claim 1, wherein the hard particles comprise:

a material selected from diamond, boron carbide, boron nitride, aluminum nitride, and carbide or borides of the group consisting of W, Ti, Mo, Nb, V, Hf, Ta, Cr, Zr, A, and Si; and the binder is selected from a group consisting of cobalt, nickel, iron, titanium and alloys thereof.

6. The method according to claim 1, wherein step (b) is performed by:

placing and sealing the powder within a flexible and impermeable container;

surrounding the container with a fluid; and applying pressure to the fluid.

7. The method according to claim 1, wherein step (b) is performed by:

placing the powder within a cavity of a rigid mold; then forcing a ram against the powder.

8. A method of manufacturing a cone for an earth boring bit, comprising:

(a) placing a powder of hard particles and a metal binder in a mold; then (b) applying pressure to the powder to form a billet;

(c) machining the billet to create a cone-shaped product out of the billet that is oversized from desired final dimension of the cone, including machining a cylindrical cavity within the billet with an oversize diameter for mounting the cone to a bearing shaft of the bit; then (d) sintering the cone-shaped product to a desired density, and allowing the cone-shaped product, including the oversize diameter of the cavity, to shrink to substantially the desired final dimension of the cone; then (e) finish machining the cylindrical cavity into a bearing surface having a desired dimension and surface finish; wherein the method further comprises:

inserting cylindrical displacement members into the holes after step (c), the displacement members being of a material that does not shrink and having the desired finished diameters for the holes;

and step (d) further comprises leaving the displacement members in the holes while sintering, allowing the powder to shrink around the displacement members to provide holes of the desired finished diameters.

9. The method according to claim 8, wherein step (c) is performed while the billet is in a completely unsintered condition.

10. The method according to claim 8, further comprising:

after step (b) and prior to step (c), heating the billet to partially sinter the billet.

11. The method according to claim 8, wherein the hard particles comprise:

a material selected from diamond, boron carbide, boron nitride, aluminum nitride, and carbide or borides of the group consisting of W, Ti, Mo, Nb, V, Hf, Ta, Cr, Zr, A, and Si; and the binder is selected from a group consisting of cobalt, nickel, iron, titanium and alloys thereof.

12. The method according to claim 8, wherein step (b) is performed by:

placing and sealing the powder within a flexible and impermeable container;

surrounding the container with a fluid; and applying pressure to the fluid.

* * * * *